US008707560B2

(12) United States Patent
Hess et al.

(10) Patent No.: US 8,707,560 B2
(45) Date of Patent: Apr. 29, 2014

(54) SPACING TOOL AND METHOD OF USE

(71) Applicant: 6 North Design LLC, St. Cloud, MN (US)

(72) Inventors: Terri A. Hess, St. Cloud, MN (US); Michael T. Hess, Minneapolis, MN (US)

(73) Assignee: 6 North Design LLC, St. Cloud, MN (US)

( * ) Notice: Subject to any disclaimer, the term of this patent is extended or adjusted under 35 U.S.C. 154(b) by 0 days.

(21) Appl. No.: 13/921,254

(22) Filed: Jun. 19, 2013

(65) Prior Publication Data

US 2013/0276307 A1 Oct. 24, 2013

Related U.S. Application Data

(62) Division of application No. 12/559,475, filed on Sep. 14, 2009, now Pat. No. 8,484,819.

(51) Int. Cl.
*A44C 27/00* (2006.01)

(52) U.S. Cl.
USPC ..... 29/896.4

(58) Field of Classification Search
USPC ..... 29/10, 241, 270, 271, 433, 464, 525.01, 29/525.02, 525.11, 559, 896.4, 896.41, 29/896.411; 269/55, 58, 60, 63, 289 R, 269/311, 902; 63/3.1; 33/11, 446, 481, 751, 33/567, 567.1, 576; 4/505; 140/50, 101
See application file for complete search history.

(56) References Cited

U.S. PATENT DOCUMENTS

| | | | | |
|---|---|---|---|---|
| 893,875 | A | 7/1908 | Schneider | |
| 1,071,289 | A | 8/1913 | Bader | |
| 4,474,298 | A * | 10/1984 | Bishop | 211/118 |
| 7,726,631 | B2 | 6/2010 | Noe et al. | |

OTHER PUBLICATIONS

Dance Design Board, http://www.darice.com/ecom/ProductDetails.aspx?it=1902-08&oid=24002.

* cited by examiner

*Primary Examiner* — Lee D Wilson
*Assistant Examiner* — Jamal Daniel
(74) *Attorney, Agent, or Firm* — Seager, Tufte & Wickhem, LLC

(57) ABSTRACT

The invention includes a hand tool that may be used for applying a design to a jewelry line, The tool may include at least one three-dimensional object having a slot spanning at least the distance of one side of the object. The slot may be receptive to a jewelry line, such as a wire or string. The tool may include at least a first object connected to another object so the objects may abut one another or be spaced an adjustable distance apart and at least two of the slots are in-line. Further, the hand tool may be used in a method of applying a design or designs to the jewelry line by placing the line in the slot(s) and applying a stop to the line.

19 Claims, 7 Drawing Sheets

14
334
304
318
324
316
308
322
312
302
314
320

14
332
302
308
312

324
354
304
334
310
306
308
322
356
320
362
340
302
306
308
312
332
S'
A'

SPACING TOOL AND METHOD OF USE

CROSS-REFERENCE TO RELATED APPLICATIONS

This application is a divisional application of, and claims priority under 35 U.S.C. §120 to, U.S. application Ser. No. 12/559,475, entitled SPACING TOOL AND METHOD OF USE, which was filed on Sep. 14, 2009, the entire disclosure of which is incorporated herein by reference for all purposes.

BACKGROUND OF THE INVENTION

1. Field of the Invention

This invention relates to a tool for use in making jewelry. More specifically, this invention relates to a jewelry tool for applying beads to an elongated piece.

2. Background Information

Numerous tools are used while making jewelry for the purpose of being precise in the application of designs to base materials and/or spacing of those designs on the base materials. Somewhat related, it is known that symmetry and/or precision in how things appear is aesthetically pleasing to the eye. As jewelry is often worn to further enhance the aesthetic beauty of a person or object, one aspect of jewelry is that it must be aesthetically pleasing to the eye. Moreover, it is possible to further enhance the aesthetic beauty of jewelry by ensuring designs incorporated into the jewelry are symmetric or have particular spacing. The correct spacing of these designs may be what ensures that the jewelry pieces are pleasing to the eye.

One commonly known method of spacing designs on a piece of jewelry is to use a spacing board. The spacing boards are similar to rulers and are essentially an elaborate ruler.

These spacing boards often include different jewelry designs, such as outlines for different lengths of a necklace. The necklace outline may include tic marks equally spaced apart. The tic marks are often spaced both in English and metric measure. The jewelry designs may include, but are not limited to, necklaces, rings, bracelets, etc.

SUMMARY OF THE INVENTION

Although it is known in the jewelry manufacturing art to use rulers to help space designs on a piece of jewelry, such as a necklace or bracelet, improvements are always appreciated. The inventor has recognized a need for improvement over the already existing spacing boards and/or rulers and other similar devices.

In an embodiment of the invention, a hand tool has been invented to assist jewelry designers in spacing and placing beads and other designs on a jewelry base material (i.e., jewelry line), such as a string, rope or chain. Although this tool may be any shape having at least two sides spaced any distance apart greater than zero distance, generally, it may be in a three-dimensional shape having at least six sides. On at least one side of the tool there may be a slit for allowing insertion of a string, line, rope or chain. Moreover, the slit may be in a v-shape allowing for different sized jewelry base materials. Gravity may be used to ensure the jewelry based material rests as close to the nadir of the v-shaped slot. Insertion of a jewelry based material into the tool may allow for a jeweler to precisely space designs on the material or line.

Further, another aspect of the invention may include connecting multiple three-dimensional tools to one another to form a larger multi-piece three-dimensional tool. Although the three-dimensional tools may be connected in any number of different connection techniques, the inventor has realized a particularly efficient way of connection. This connection technique includes placing a hole in each three-dimensional tool. This hole may be placed a uniform distance above a bottom surface of each three-dimensional piece. When the three-dimensional tools are connected this uniform spacing allows for at least the bottom surface of the larger multi-piece three-dimensional tool to be a generally planar surface. To complete the connection of the three-dimensional tools a bolt may be placed through the any number of three-dimensional tools that are to be connected. Finally, on the end of the bolt that was placed through the three-dimensional tools a nut may be screw fastened to the bolt so as to keep the three-dimensional tools in tight proximity with one another and resulting in a multi-piece three-dimensional tool. This multi-piece three-dimensional tool may have a slot on the generally planar bottom surface running the distance of the longer direction.

Further, in another aspect of the invention a tool includes a first three-dimensional piece and a second three-dimensional piece. The first three-dimensional piece may have three elongated pieces extending in the same direction from the perimeter of the first three-dimensional piece. The three elongated pieces may form a general u-shape. The second three-dimensional piece has a perimeter that substantially fits within the u-shape formed from the three-elongated pieces. The first three-dimensional piece and the second three-dimensional may be in communication via a bolt or other threaded device. The bolt may be placed through a hole in the first three-dimensional piece and through a nut attached to and a whole in the second three-dimensional piece. The bolt and nut arrangement may allow the distance between the first three-dimensional piece and the second three-dimensional piece to be adjusted linearly by rotating the bolt through the nut. When rotating the bolt through the nut, the second three-dimensional piece may be prevented from rotating by abutting the surrounding u-shaped elongated pieces.

Although a user may use the subject tool in a multitude of methods, an embodiment of the invention comprises a user using the tool in an illusion jewelry method. An aspect of this method includes a user placing a stop on a jewelry base material or line and applying a first design. For example, the first design may be a first bead cluster. After the first stop and design are applied to the jewelry base material as second stop may be applied to the material so the design is between the first and second stop. Then, a user may place the jewelry base material in the slot of the three-dimensional tool. When the base material is placed in the slot(s), the second stop may abut a first side of the tool and a third stop may be applied to the material and the third stop may abut a second side of the tool.

Further, a user may wish to apply the jewelry base material to the three-dimensional tool prior to placing a design on the jewelry base material. Then once the jewelry base material is placed in the three-dimensional tool, stops are applied to either end or both ends of the jewelry base material and spaced apart by the width of the slot or the width of these space between sides of the three-dimensional tool.

Yet further, a user may use the above mentioned techniques or other techniques appreciated by the inventor and not herein described with the multi-piece three-dimensional tool.

The above summary of the present invention is not intended to describe each illustrated embodiment, aspect or every implementation of the present invention. The figures and detailed description that follow more particularly exemplify these and other embodiments and further aspects of the invention,

BRIEF DESCRIPTION OF THE DRAWINGS

The invention may be more completely understood in consideration of the following description of various embodiments of the invention in connection with the accompanying drawings, in which.

Figure 1:
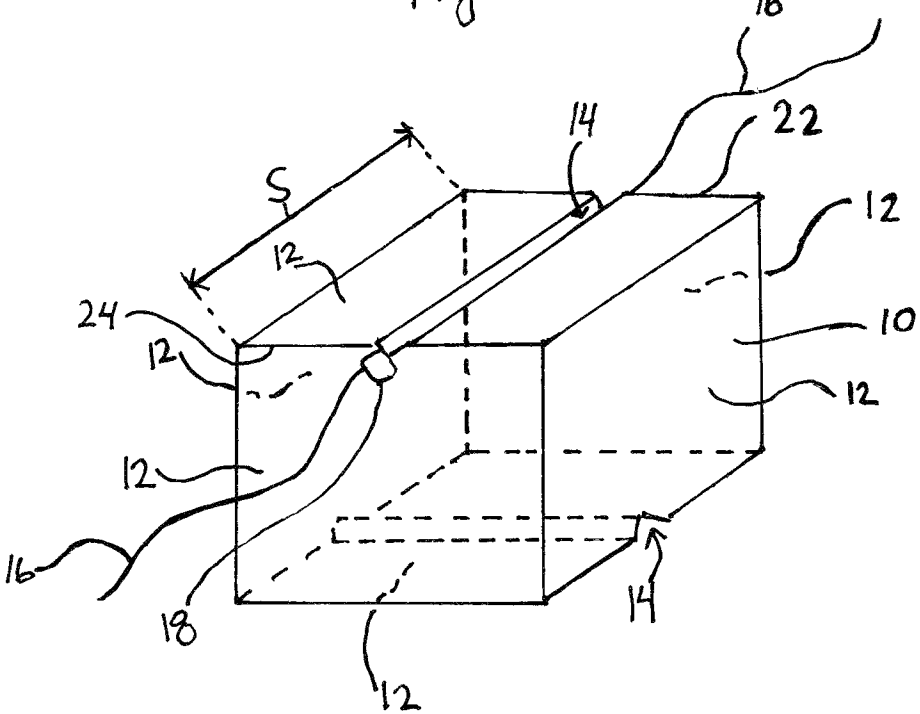
FIG. 1 is a perspective view of an aspect of the invention.

While the invention is amenable to various modifications and alternative forms, specifics thereof have been shown by way of example in the drawings and will be described in detail. It should be understood, however, that the intention is not necessarily to limit the invention of the particular embodiments described. On the contrary, the intention is to cover all modifications, equivalents, and alternatives falling within the spirit and scope of the invention and as defined by the appended claims.

DETAILED DESCRIPTION OF THE INVENTION

Referring now to the Figures, a single block jewelry jig 10 is depicted in FIG. 1. This single block jewelry jig 10 may be a three-dimensional solid block having six sides and twelve edges. In other embodiments the single block jewelry jig 10 may be hollow, may have any number of sides and/or may have open sides defined by a frame-like structure having at least nine edges. Further, the single block jewelry jig 10 may be made out of any material and is preferably made from a low cost material that is easily and efficiently manufactured. Such a material may be any type of wood or an inexpensive polymer material.

The single block jewelry jig 10 may have six sides 12; however, as mentioned above, single block jewelry jig 10 may have any number of sides, where at least a first edge 22 is separated from a second edge 24 by a space S.

Single block jewelry jig 10 may have an indentation 14 that spans at least the distance S from first edge 22 to second edge 24. Indentation 14 may be a slit that is at least as deep as it is wide; however the indentation 14 may have any dimensions as long as a jewelry line 16 may be placed in the indentation 14. Moreover, as in FIG. 1, indentation 14 may be v-shaped, which allows for various jewelry lines have differing gauges (i.e., thickness of the jewelry line). In order to assist in securing (e.g. to avoid slippage) a jewelry line 16 in indentation 14, indentation 14 may have a material (not shown) placed in the indentation to help hold the jewelry line 16 in place in indentation 14. Such material may be a rubber or other material capable of releasably securing jewelry line 16. Further, there may be numerous indentations 14 on a single side of single block jewelry jig 10 and those indentations 14 may span the same or different distance(s) S.

As shown in FIG. 1, single block jewelry jig 10 may have indentations 14 on more than one side 12. An at least second indentation 14 may be located on a side opposite the side the first indentation is located. At least second indentation 14 may be located in a direction that intersects the first indentation if the first indentation 14 were in the same plane as at least second indentation 13.

Figure 3:
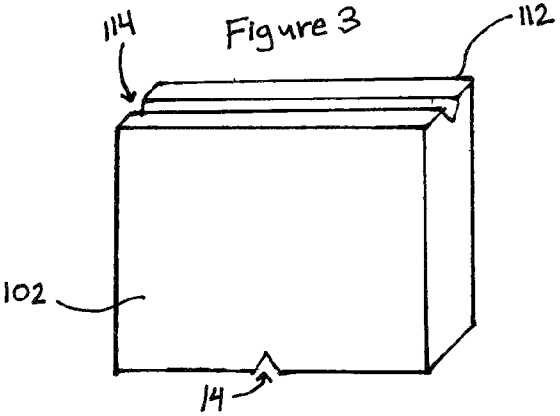
FIG. 3 is a perspective view of a feature of an aspect of the invention.

Another aspect of the invention may include jewelry jig 100 having at least two end portions (e.g., two single block jewelry jigs 10), a first end portion 102 and a second end portion 104. Both end portions 102, 104 may have at least one indentation 14. Indentations 14 in each end portion 102, 104 are preferably in line with each other so as to allow a jewelry line 16 to be inserted in indentations 14. There may be multiple indentations 14 in each end portion 102, 104. Further, there may be the same number of indentations 14 in each end portion 102, 104. As shown in FIG. 3, there may be an indentation 114 in a bottom side 112 of an end portion or both end portions 102, 104.

Figure 2:
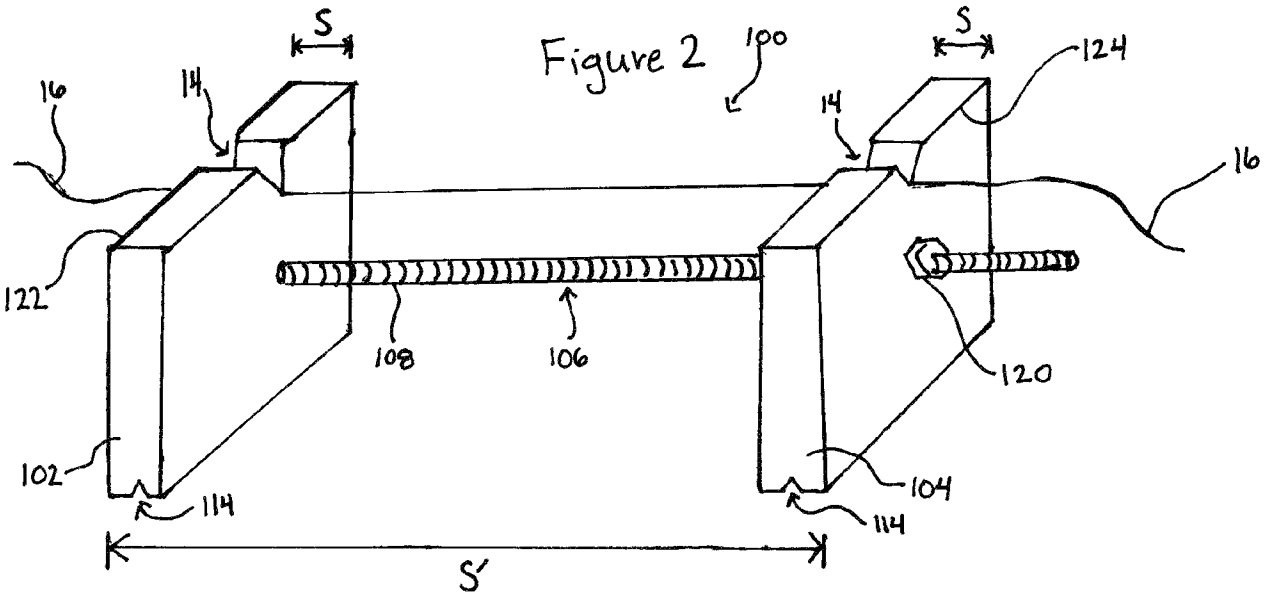
FIG. 2 is a perspective view of an aspect of the invention.

First end portion 102 may be connected to second end portion 104 by any connection means 106. Connection means 106 is preferably connected to first end portion 102 and second end portion 104 in a manner that allows the distance S between first edge 122 and second edge 124 to be adjusted to be any distance. The connection means 106 may be a screw (threaded) type 108 (FIG. 2) or a slot type 110 (FIG. 4) or any other connection commonly used to separate one working piece from another working piece, Connection means 106 may have a label or indicia (not shown) that is a measuring label, similar to a ruler as commonly understood in the art for the potential purpose of allowing a jeweler, artist or artisan to determine the distance S between first edge 122 and second edge 124 without the use of a third-party tool.

Screw type 108 connection means 106 may be fixedly connected to a first end portion 102 by any means; for example, by a liquid fastener such as glue. As an alternative, screw type 108 connection means 106 may be slidably connected to a first end portion 102. When the screw type connection 108 is used, connection 108 may engage a nut 120 fixedly attached to second end portion 104. In addition, screw type 108 connection means 106 may be connected to first end portion 102 in the same or similar manner it is connected to second end portion 104. With the screw type 108 connection fixedly connected to first end portion 102, the distance S between first end portion 102 and second end portion 104 is adjusted by rotating or twisting second end portion 104 in a manner similar to how a nut is fastened or removed from a screw or bolt. For example, when second end portion 104 is rotated in a first direction (e.g., clock-wise), it may get closer to first end portion 102 and when second end portion 104 is rotated in a second direction (e.g., counter clock-wise), distance S' increases. When screw type connection 108 is slidably connected to first end portion 102, the distance S' is adjusted by rotating screw type connection 108 and through nut 120 and substantially maintaining first end and second end portions' 102, 104 rotational position with respect to one another and the rotation of screw type connection 108 causes lateral movement from rotational movement.

Figure 4:
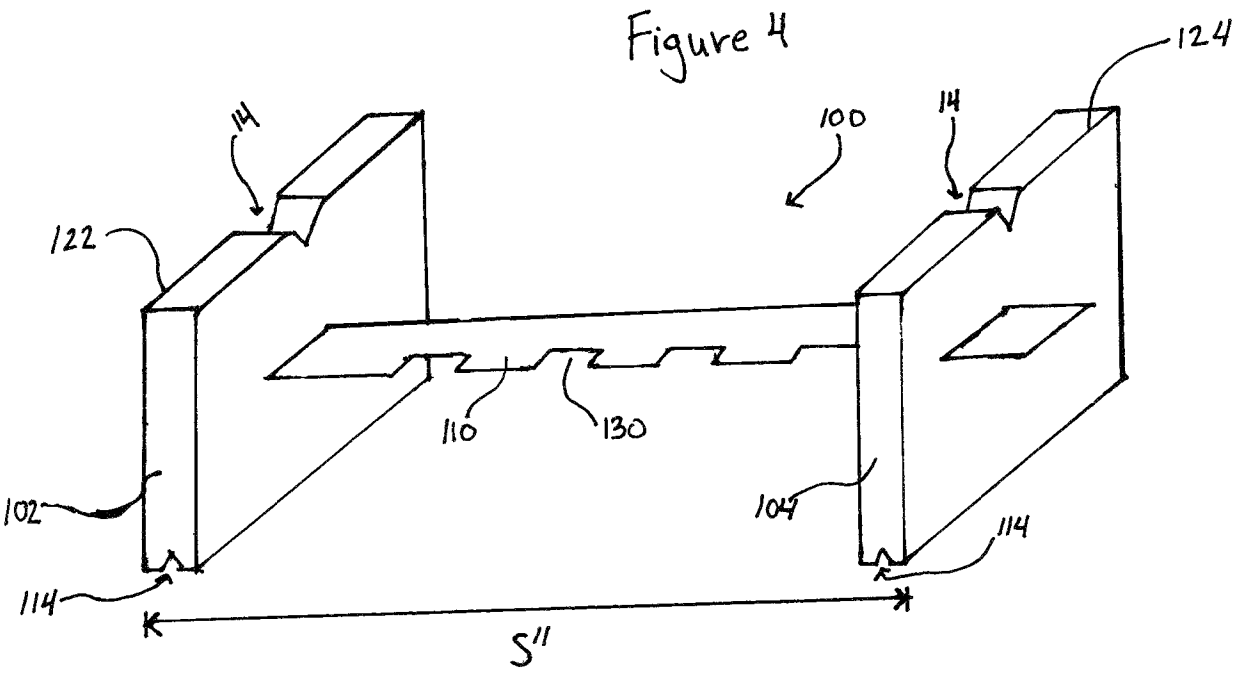
FIG. 4 is a perspective view of an aspect of the invention.

Slot type 110 connection means 106, as shown in FIG. 4, may be fixedly or slidably connected to a first end portion 102. The slot type 110 connection means 106 may have slots 130 that allow for first end portion 102 and/or second end portion 104 to adjustably engage slot type 110 connection. The distance S" between first end portion 102 and second end portion 104 may be adjusted by sliding either first end portion 102 or second portion 104 in a direction toward or away from the other end portion and engaging a slot 130 in slot type 110 connection.

Further, the distance S of first end portion 102 and second end portion 104 may be the same distance or may one end portion 102, 104 may have a larger distance S. Having different distances S on different end portions may allow for an indentation 14 to be utilized to apply designs to a jewelry line 16 at intervals of distances smaller than S of one of the end portions. Moreover, there may be any number of end portions connected to connection means 106.

Figure 5:
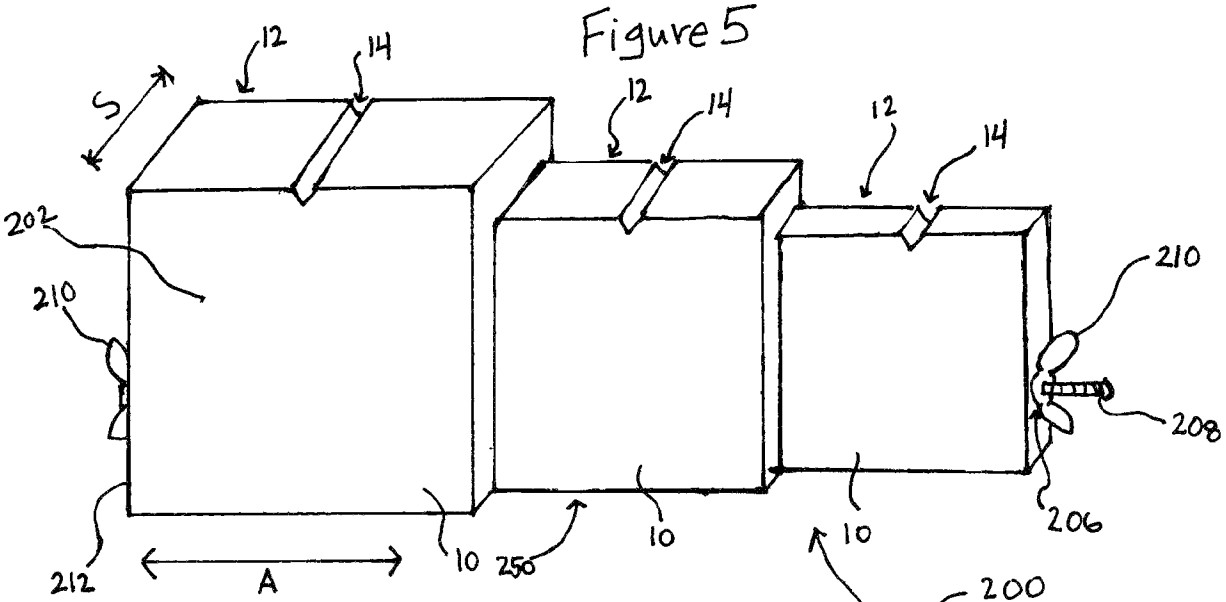
FIG. 5 is a perspective view of an aspect of the invention.
Figure 6:
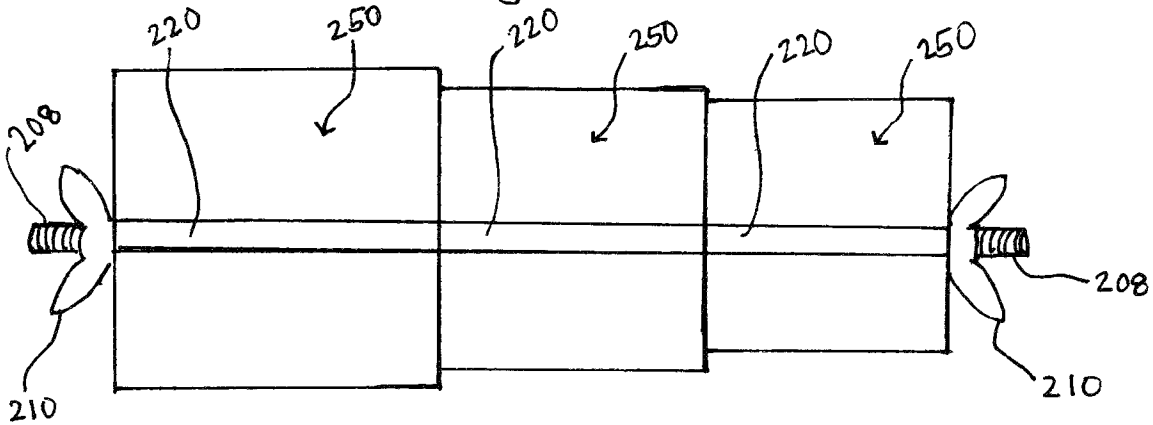
FIG. 6 is a bottom view of FIG. 5.

In another aspect, shown in FIGS. 5 and 6, single block jewelry jig 202 (e.g., single block jewelry jig 10) may be connected in an adjacent manner to other single block jewelry jigs 202 to form an extended jewelry jig 200. The other single block jewelry jigs 202 may be the same or different sizes as a first single block jewelry jig 202. Also, the other single block jewelry jigs 202 attached to the first single block jewelry jig 202 may vary in size with respect to first single block jewelry jig 202 and each other. The extended jewelry jig 200 may have any number of single block jewelry jigs 202 attached to a first single block jewelry jig 202. Each attached single block jewelry jig 202 may have an indentation 14 spanning a side of jewelry jig 202 in a direction generally perpendicular to the direction of attachment A of the single block jewelry jigs, as depicted in FIG. 5. Each of the attached single block jewelry jigs 202 may have a hole 206 of any shape or size allowing for an attaching means 204 to releasably attach the jewelry jigs to one another. Connection means 208 may be inserted into holes 206. Connection means 208 may be a screw or bolt or any other connection means. Bolt or screw may have a head (not shown) that abuts extended jewelry jig 200 at a first end 212 and a nut 210 of any type may abut extended jewelry jig 200 at a second end 214. Nut 210 may be wing nut as shown in FIGS. 5 and 6. Nut 210 may be tightened to ensure jewelry blocks are tightly connected to form an effective extended jewelry jig 200.

The attached single block jewelry jigs may attach to one another so that a bottom side 250 of each attached single block jewelry jig is flush in a single plane. Bottom sides 250 may each have a second indentation 220 that generally have the same features of indention 14, but generally perpendicular to indentation 14, As the bottom sides 250 of the attached single block jewelry jigs form a single plane the second indentations 220 may be connected so as to form an extended indentation 222. Indentation 14 may be located on any side or all sides of single block jewelry jig 202. It may be preferable that at least one indentation 14 may be located on a side that is not bottom side 250; is not a side in direct contact with another single block jewelry jig 202; and is not a side having hole 206.

Further, any attaching means 204 may be utilized and may be any structure that is commonly used to attach two or more objects together. The attaching means may be a permanent attaching means, for example a glue or other at least semi-permanent attaching equivalent. The attaching means 204 may be an adjustable attaching means that may have a screw piece 214 extending through extended jewelry jig 200 and a wing nut 216 connected to screw piece 214 at each end of extended jewelry jig 200. Other releasable attaching means may be utilized as many equivalent attaching means having various features, including sliding, screwing, slotting and other features known in the art for attaching different works pieces to one another.

Figure 7:
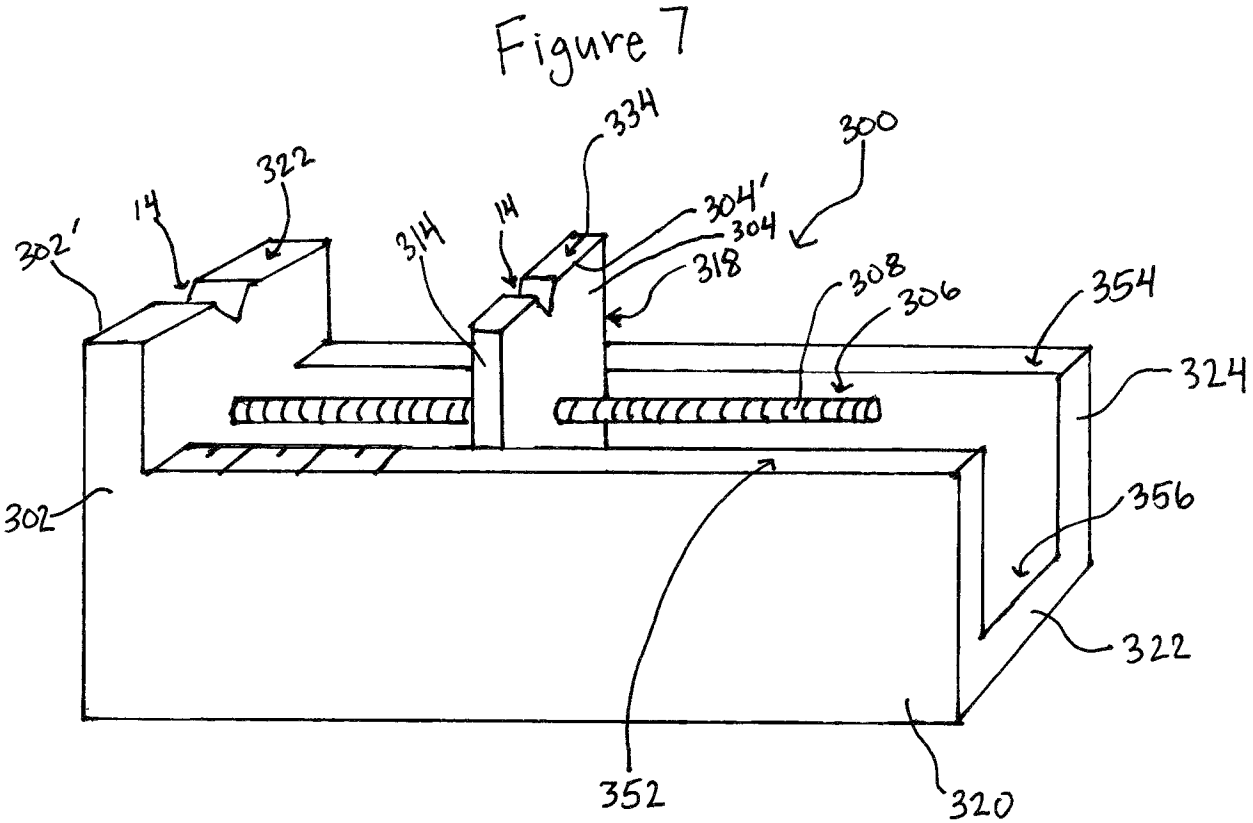
FIG. 7 is a perspective view of an aspect of the invention.
Figure 10:
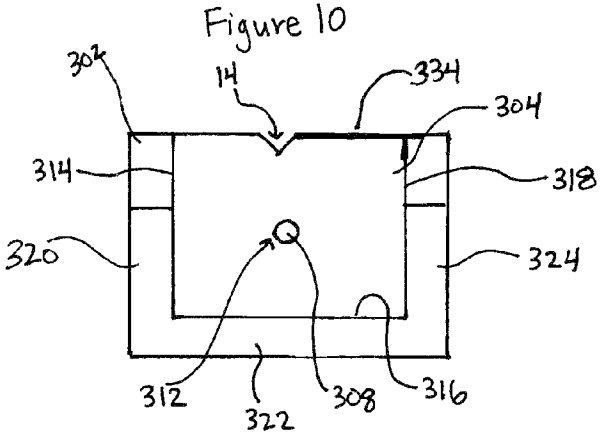
FIG. 10 is a second end view of FIG. 7.
Figure 9:
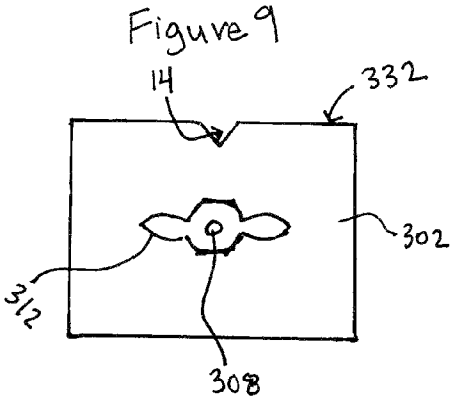
FIG. 9 is a first end view of FIG. 7.
Figure 8:
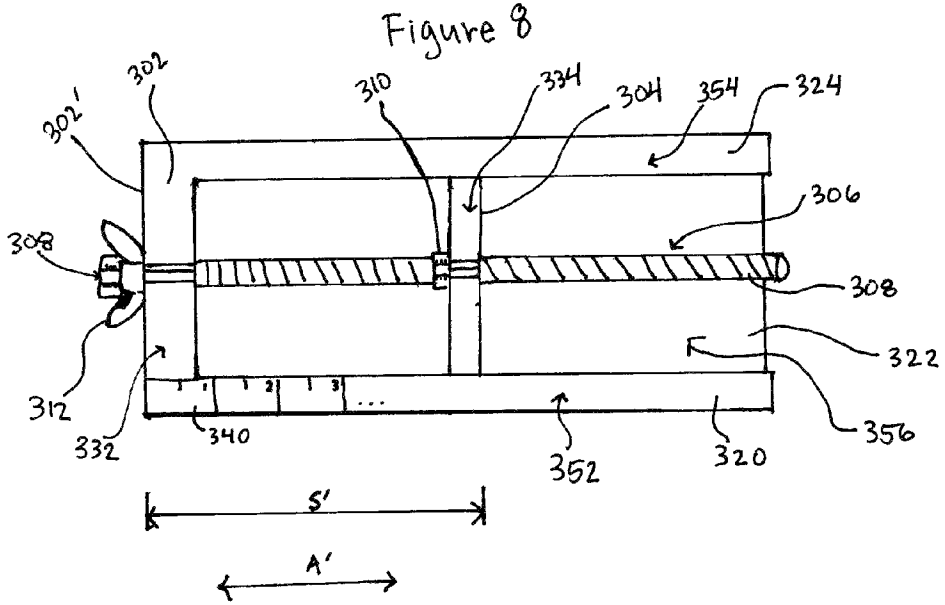
FIG. 8 is a top view of FIG. 7.
Figure 11:
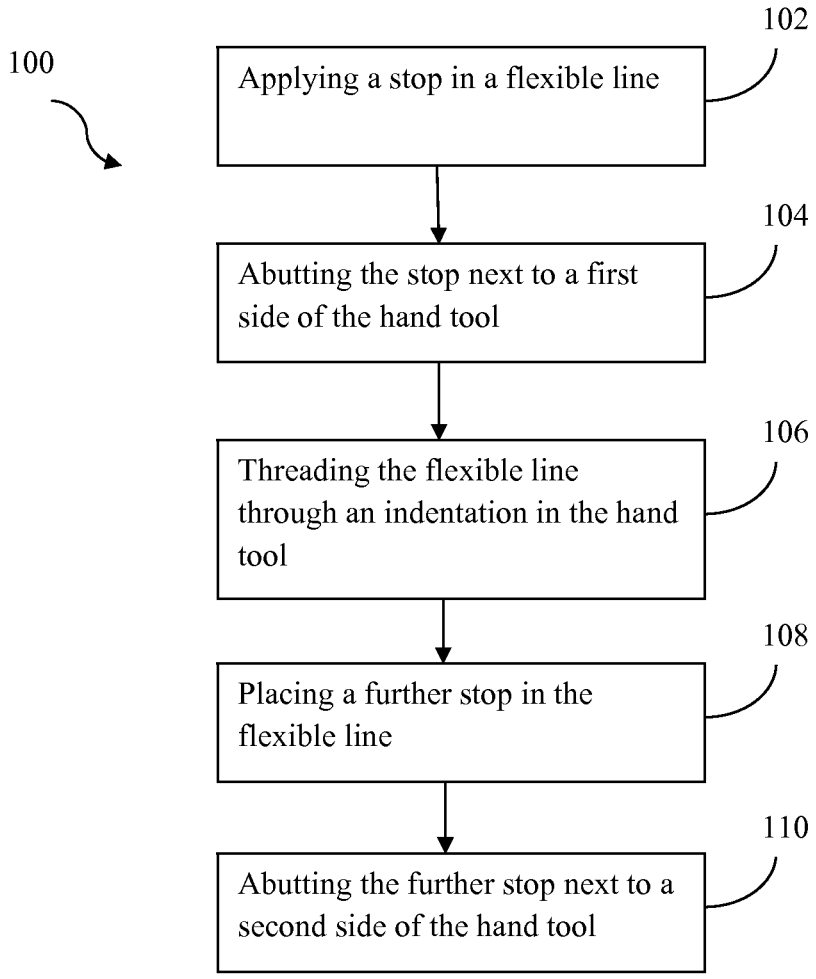
FIG. 11 is a schematic flow diagram of an illustrative method of using an illustrative hand tool.

As shown in FIG. 7, jewelry jig 300 may have a first end piece 302 (e.g., similar to or identical to jewelry jig 10) and a second end piece 304 (e.g., similar to jewelry jig 10). Both first end piece 302 and second end piece 304 may have at least one slot 14 on top sides 332, 334 and both end pieces 302, 304 may be any shape. Slots 14 may be slotted in a direction of movement A' and at least one slot 14 in first end piece 302 may be directly in-line with at least one slot 14 in second end piece 304. Distance 8' is the distance from first end piece edge 302' and second end piece edge 304'. First end piece 302 and second end piece 304 may be connected by any adjustable connection means allowing for distance S' to be adjusted as desired by a user. For example, connection means may be a screw-type connection means 306 having threads. Screw type connection means 306 may include a screw piece 308, nut piece 310 (see FIG. 8) and winding piece 312 (see FIGS. 8 and 9). Screw piece 308 may slidably engage first end piece 302 through a first hole (not shown) in first end piece 302. Further, screw piece 308 may rotatably engage nut piece 310 fixedly attached to second end 304. Nut piece 310 may be located on any side of second end piece 304 or inside second end piece 304 allowing screw piece 308 to enter a second hole 312 that is directly in-line with first hole in first end 302 and a threaded hole of nut piece 310. Thus, by rotating screw piece 308, second end 304 travels linearly along screw piece 308 in the direction of A'.

In a further aspect of the jewelry jig 300, second end piece 304 may be abutted on at least one side 314, 316, 318 by at least one side piece 320, 324 and/or bottom piece 322. At least one side 314, 316, 318 may at least be partially abutting a side piece 320, 324 or bottom piece 322. Further, at least one side 314, 316, 318 may be at least substantially abutting a side piece 320, 324 or bottom piece 322. Yet further, as shown in FIGS. 7-10, at least two or more sides 314, 316, 318 are at least partially abutting side pieces 320, 324 and/or bottom piece 322. Although sides 314, 316, 318 may abut side pieces 320, 324 and/or bottom piece 322, sides 314, 316, 318 should abut side pieces 320, 324 and/or bottom piece 322 in a manner that allows for second end piece 304 to move along screw piece 308 in the direction of A' as screw piece 308 is rotated. Side pieces 320, 324 and bottom piece 322 may be any shape or size, but preferably are shaped to slidably abut the contour of at least second end piece 304. Further, side pieces 320, 324 and/or bottom piece 322 may abut second end piece 304 in a manner that facilitates the stability of jewelry jig 300 and the movement of second end piece 304 with respect to first end 302 in a direction A'. Yet further, side pieces 320, 324 and/or bottom piece 322 may be attached to, or integrally formed with, first end piece 302.

Further, jewelry jig 300 (as well as all other similarly described jewelry jigs 10, 102, 104, 200, 202 discussed) may include a label or indicia 340. Label or indicia 340 may be fixed to and located anywhere on jewelry jig 300. For example, label or indicia 340 may be located on any one of or any combination of top surfaces 352, 354, 356 of side pieces 320, 324 or bottom piece 322 and label or indicia 340 may be parallel to indentations 14. Label or indicia 340 may be a measuring label or tool, similar to a ruler as commonly understood in the art for the potential purpose of a jeweler, artist or artisan to determine the distance S' between first end piece edge 302' and second end piece edge 304' without the use of a third-party tool.

The jewelry jig of the invention may be used in numerous methods. For example, a method may include using the jewelry jig of the invention for placing a design on a jewelry line 16. Jewelry line 16 may be placed in a slot 14 in the jewelry jig or in multiple slots that are in-line with one another, but are located on separate ends or separate three-dimensional objects (see FIGS. 1 and 2). As is generally known in the art, crimping tools and crimps are known for applying designs to a jewelry line. Stops 18, for example crimps or knots or glue or other line 16 engaging pieces or material, may be used on ends of designs for the purpose of securing a jewelry design to a desired location along jewelry line 16. As mentioned above, symmetry or particular spacing may be generally pleasing to the eye and securing a jewelry design at a location along jewelry line 16 may maintain symmetry of design(s) along jewelry line 16.

In a method 100 of using a jewelry jig 10, a user may choose a jewelry jig having an indentation 14 spanning a desired length or may adjust a jewelry jig so indentation(s) 14 are separated or form an indentation of a desired length. Next a user may apply at least a first stop 18, for example a crimp or knot (not particularly shown for clarity purpose), to a jewelry line 16 and apply a design to the jewelry line 16. Stop 18 may be applied to jewelry line 16 by any conventional known crimping or knotting or other technique common in the art of crimping or knotting. Then the user may apply or place 102 at least a second stop 18 to or in jewelry line 16 to secure a design between two stops 18, (e.g., between two knots or two crimps or a combination thereof). Then a user may place or abut 104 the at least second stop 18 at one end of the chosen and /or adjusted jewelry jig, along an edge of the jig, and pull or thread 106 the jewelry line 16 through indentation(s) 14, preferably so jewelry line 16 is taut. Next a third stop 18 may be placed 108 on or in the jewelry line 16 at a second end of the jewelry jig so that third stop directly abuts 110 an edge of the second end of the jewelry jig. Once the third stop is in place, the process may be repeated until the jewelry or overall design is completed.

The methods of use described heretofore are only examples of methods of use. It is clear that one skilled in the art may develop other methods of use as suggested by the description that are in the spirit of the invention and are not intended to be excluded from the scope of the invention by not being specifically recited.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular JEWELRY JIG AND METHOD OF USING as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A method of using a hand tool, the method comprising:
placing a first stop in a flexible line;
abutting the first stop against a first side of the hand tool;
threading the flexible line through an indentation of the hand tool,
placing a second stop in the flexible line;
abutting the second stop against a second side of the hand tool; and
adjusting a distance from the first side of the hand tool to the second side of the hand tool.

2. The method of claim 1, wherein adjusting a distance from the first side of the hand tool to the second side of the hand tool comprises adjusting a distance between a first end portion of the hand tool and a second end portion of the hand tool.

3. The method of claim 2, wherein adjusting a distance between a first end portion of the hand tool and a second end portion of the hand tool comprises rotating a threaded connector, where the threaded connector extends through the first end portion and is in communication with the second end portion.

4. The method of claim 1, further comprising:
selecting one or more blocks from a set of blocks; and
wherein each block of the set of blocks has an indentation and the indentation of each block of the set of blocks spans a distance different than a distance of at least one other block of the set of blocks; and
wherein the indentations of the selected one or more blocks form the indentation of the hand tool.

5. The method of claim 4, wherein adjusting a distance from the first side of the hand tool to the second side of the hand tool comprises:
adding one or more blocks from the set of blocks to the selected one or more blocks; and
aligning the indentations of the added one or more blocks and the selected one or more blocks to form the indentation of the hand tool.

6. The method of claim 1, further comprising:
applying a design to the flexible line.

7. The method of claim 1, further comprising:
abutting the second stop against the first side of the hand tool.

8. The method of claim 7, further comprising:
placing a third stop in the flexible line.

9. The method of claim 8, further comprising:
abutting the third stop next to the second side of the hand tool.

10. The method of claim 9, wherein the first stop, the second stop, and the third stop are sequentially positioned along the flexible line.

11. A method of using an adjustable hand tool including a first end portion and a second end portion, where a connector adjustably connects the first end portion and the second portion, the method comprising:
rotating a connector adjustably connecting a first end portion of the hand tool to a second end portion of the hand tool to linearly adjust a distance between the first end portion of the hand tool and the second end portion of the hand tool; and
abutting a first feature on a line adjacent the first end portion of an adjustable hand tool;
extending the line through the first end portion of the hand tool;
extending the line through the second end portion of the hand tool; and
abutting a second feature in the line adjacent the second end portion of the hand tool; and
wherein the second end portion of the hand tool is substantially in-line with the first end portion of the hand tool.

12. The method of claim 11, wherein extending the line through the second end portion of the hand tool comprises:
positioning the line in a slot in the second end portion of the hand tool.

13. The method of claim 11, wherein extending the line through the first end portion of the hand tool comprises:

positioning the line in a slot in the first end portion of the hand tool.

14. The method of claim 11, wherein the first end portion of the hand tool has a first slot and the second end portion of the hand tool has a second slot in-line with the first slot.

15. The method of claim 14, wherein one of the first end portion of the hand tool and the second end portion of the hand tool has a third slot extending substantially perpendicular to the first slot and the second slot.

16. A method of using a hand tool, where the hand tool includes a line receiving slot having an adjustable distance extending between a first end of the line receiving slot and a second end of the line receiving slot, the method comprising:

setting a distance between a first end of a line receiving slot and a second end of the line receiving slot;

positioning a line in the line receiving slot;

abutting a first feature in the line against the first end of the line receiving slot; and abutting a second feature in the line against the second end of the line receiving slot; and abutting a third feature in the line against the second end of the line receiving slot.

17. The method of claim 16, further comprising:

aligning a slot of a first portion of the hand tool forming the first end of the line receiving slot with a slot of a second portion of the hand tool forming the second end of the line receiving slot.

18. The method of claim 16, wherein setting a distance between the first end of the line receiving slot and the second end of the line receiving slot includes adjusting a distance between the first end of the line receiving slot and the second end of the line receiving slot.

19. The method of claim 16, further comprising:

abutting the second feature in the line against the first end of the line receiving slot after abutting the second feature in the line against the second end of the line receiving slot.

* * * * *

UNITED STATES PATENT AND TRADEMARK OFFICE

CERTIFICATE OF CORRECTION

PATENT NO. : 8,707,560 B2
APPLICATION NO. : 13/921254
DATED : April 29, 2014
INVENTOR(S) : Hess et al.

It is certified that error appears in the above-identified patent and that said Letters Patent is hereby corrected as shown below:

On the Title Page

Item (57) ABSTRACT
Line 2: after "to a jewelry line", delete "," and insert therefor --.--

In the Specification

Column 2
Line 67: after "invention", delete "," and insert therefor --.--

Column 4
Line 24: after "another working piece", delete "," and insert therefor --.--

Column 5
Line 37: after "to indentation 14", delete "," and insert therefor --.--

Signed and Sealed this
Sixteenth Day of September, 2014

Michelle K. Lee

Michelle K. Lee
*Deputy Director of the United States Patent and Trademark Office*